US010262769B2

(12) United States Patent
Shirai et al.

(10) Patent No.: US 10,262,769 B2
(45) Date of Patent: Apr. 16, 2019

(54) WIRE HARNESS

(71) Applicant: Yazaki Corporation, Minato-ku, Tokyo (JP)

(72) Inventors: Mizuki Shirai, Susono (JP); Hiroki Kondo, Susono (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/718,185

(22) Filed: Sep. 28, 2017

(65) Prior Publication Data

US 2018/0130572 A1 May 10, 2018

(30) Foreign Application Priority Data

Nov. 8, 2016 (JP) ..... 2016-217913

(51) Int. Cl.
*H01B 7/08* (2006.01)
*H01B 7/00* (2006.01)
*H01B 11/10* (2006.01)

(52) U.S. Cl.
CPC ..... *H01B 7/0823* (2013.01); *H01B 7/0045* (2013.01); *H01B 11/1091* (2013.01); *H01B 11/10* (2013.01)

(58) Field of Classification Search
CPC ..... H01B 7/08
USPC ..... 174/117 F
See application file for complete search history.

(56) References Cited

U.S. PATENT DOCUMENTS 5,455,383 A * 10/1995 Tanaka ..... H01B 7/0861 174/117 A
6,870,105 B2 * 3/2005 Maydanich ..... H01B 7/0861 174/117 F
7,667,138 B2 * 2/2010 Koga ..... H01B 7/0861 174/110 R
9,629,234 B2 * 4/2017 Tomikawa ..... H05K 1/0216
2002/0062979 A1 * 5/2002 Murakami ..... H01B 7/0861 174/117 F
2014/0014409 A1 * 1/2014 Lin ..... H02G 15/08 174/75 R

FOREIGN PATENT DOCUMENTS

JP 20084464 A 1/2008
JP 2011165393 A 8/2011

* cited by examiner

*Primary Examiner* — Chau N Nguyen
(74) *Attorney, Agent, or Firm* — Sughrue Mion, PLLC

(57) ABSTRACT

A wire harness includes a flat shielded cable, a first device connected to one end of the flat shielded cable, and a second device connected to the other end of the flat shielded cable. The flat shielded cable includes a plurality of conductors arranged in parallel, an insulating jacket section that covers the plurality of conductors and has an exposed conductor section which exposes a part of at least one of the conductors, and a shielding member that covers an outer periphery of the jacket section. A signal is transmitted from the first device to the second device through a conductor other than the conductor provided with the exposed conductor section. The at least one of the conductors is connected to a ground at a position between the exposed conductor section and the second device.

5 Claims, 7 Drawing Sheets

WIRE HARNESS

CROSS REFERENCE TO RELATED APPLICATIONS

This application is based on Japanese Patent Application (No. 2016-217913) filed on Nov. 8, 2016, the contents of which are incorporated herein by reference.

BACKGROUND OF THE INVENTION

1. Field of the Invention

The present invention relates to a wire harness.

2. Description of the Related Art

Recently, shielded electric wires are known in which electric wires are each entirely coated with a shielding layer, such as metal foil or metal braid, to prevent the malfunction of various kinds of electronic apparatuses due to external noise. Furthermore, flat shielded cables have also been proposed in which flat cables are each provided with a shielding layer. In this kind of flat shielded cable, the jacket section of a conductor of a plurality of conductors arranged in parallel, serving as a drain wire, is removed, and the outer periphery of the conductor is coated with a shielding layer. An adhesive layer containing conductive filler or conductive paste intervenes between the shielding layer and the exposed conductor section from which the jacket portion is removed, and the drain wire is electrically connected to the shielding layer via this intervening substance (refer to JP-A-2008-4464 and JP-A-2011-165393).

However, in the case in which the flat shielded cables described in Patent JP-A-2008-4464 and JP-A-2011-165393 are partially used in wire harnesses, the shielding performance thereof still has room for improvement.

SUMMARY OF THE INVENTION

The present invention has been made to solve the conventional problem described above and an object of the present invention is to provide a wire harness capable of improving shielding performance.

A wire harness according to the present invention includes:

a flat shielded cable including:

a plurality of conductors arranged in parallel to each other;

an insulating jacket section that covers the plurality of conductors and has an exposed conductor section which exposes a part of at least one of the conductors; and a shielding member that covers an outer periphery of the jacket section, the part of the at least one of the conductors being electrically connected to the shielding member via the exposed conductor section;

a first device configured to be connected to one end of the flat shielded cable; and a second device configured to be connected to the other end of the flat shielded cable, wherein a signal is transmitted from the first device to the second device through a conductor other than the conductor provided with the exposed conductor section from among the plurality of conductors; and wherein the at least one of the conductors is connected to a ground at a position between the exposed conductor section and the second device.

With this wire harness, since the at least one of the conductors provided with the exposed conductor section is connected to the ground at a portion of the conductor on the side of the second device rather than the portion provided with the exposed conductor section, the induction current generated by the noise flowing through the at least one of the conductors flows in the direction toward the second device. Furthermore, since the signal flows from the first device to the second device in the conductor not provided with the exposed conductor section, the induction current and the signal flow in the same direction. The inventors of the present invention have found that, when the induction current generated by the noise is transmitted in the same direction as the direction of the signal and grounded, the noise hardly affects the signal. Consequently, the shielding performance can be improved in the case in which the induction current generated by the noise and the signal are made to flow in the same direction.

Furthermore, in the wire harness according to the present invention, for example, the exposed conductor section is provided so that a distance between the exposed conductor section and the second device is smaller than a distance between the exposed conductor section and the first device.

With this wire harness, since the exposed conductor section is provided on ae side of the at least one of the conductors closer to the second device than to the first device, the induction current generated by the noise flows only a relatively short distance through the at least one of the conductors. Hence, the influence of the noise on the signal can be further reduced, and the shielding performance can be further improved.

Moreover, in the wire harness according to the present invention, for example, the exposed conductor section is provided at a position away from an end section of the shielding member connected to the second device by a distance of 150 mm or less.

With this wire harness, since the exposed conductor section is provided at the portion of the shielding member away from the end section of the shielding member on the side of the second device by a distance of 150 mm or less, the exposed conductor section is formed at the portion closer to the side of the second device in the range of the conductor protected by the shielding member, whereby the induction current is made to flow only a further shorter distance through the at least one conductor and the shielding performance can be further improved.

Still further, a wire harness according to the present invention includes:

a flat shielded cable including:

a plurality of conductors arranged in parallel to each other;

an insulating jacket section that covers the plurality of conductors and has an exposed conductor section which exposes a part of at least one of the conductors; and a shielding member that covers an outer periphery of the jacket section, the part of the at least one of the conductors being electrically connected to the shielding member via the exposed conductor section, wherein the at least one of the conductors is connected to a ground at a position closer to one end section than to the other end section of the at least one of the conductors; and wherein the exposed conductor section is provided at a position closer to the one end section than to the other end section of the at least one of the conductors.

With this wire harness, since the exposed conductor section is provided on the side of the at least one of the conductors closer to the one end section of the conductor to be connected to the ground, the induction current generated by the noise flows only a relatively short distance through the at least one conductor. Hence, the influence of the induction current on the signal can be reduced, and the shielding performance can be improved.

Moreover, in the wire harness according to the present invention, for example, the at least one of the conductors is connected to the ground at a position between the exposed conductor section and the one end section of the at least one of the conductors.

The present invention can provide a wire harness capable of improving shielding performance.

BRIEF DESCRIPTION OF THE DRAWINGS

FIG. 3A shows a first example, and FIG. 3B shows a second example;

FIG. 5A shows the case in which the induction current and the signal flow in the same direction, and FIG. 5B shows the case in which the induction current and the signal flow in the opposite directions;

DETAILED DESCRIPTION OF THE EXEMPLARY EMBODIMENTS

The present invention will be described below along with a preferred embodiment. However, the present invention is not limited to the embodiment described below, but can be modified appropriately within the scope not departing from the gist of the present invention. Furthermore, although the illustration and description of some components are omitted in the embodiment described below, it is needless to say that known or well-known technologies are applied appropriately to the details of the omitted technologies within a range not causing inconsistency with the contents of the following description.

Figure 1:
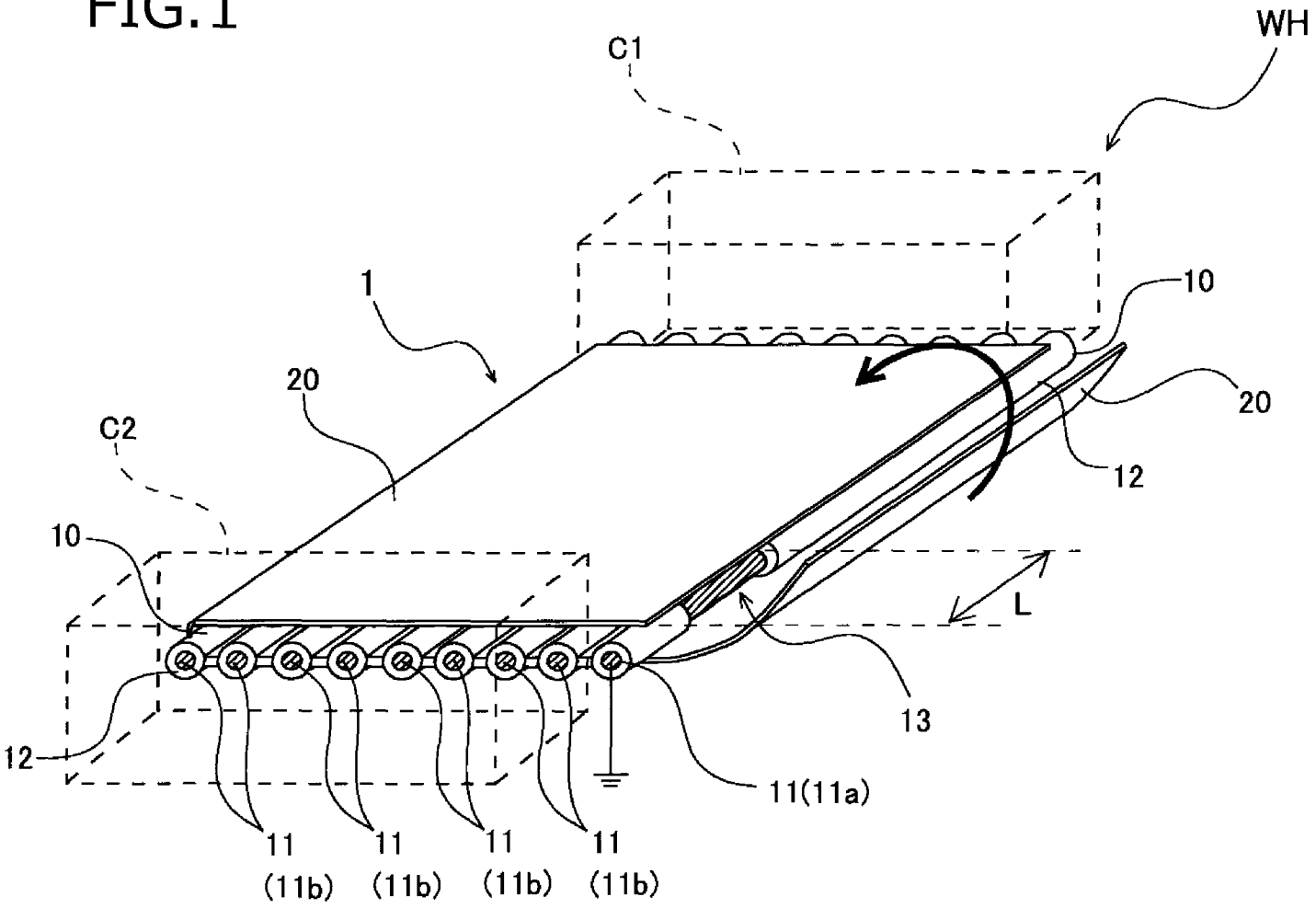
FIG. 1 is a perspective view showing a wire harness including a flat shielded cable according to an embodiment of the present invention.

FIG. 1 is a perspective view showing a wire harness including a flat shielded cable according to the embodiment of the present invention. As shown in FIG. 1, a wire harness WH is constituted by a flat shielded cable 1, a first device C1 and a second device C2.

The flat shielded cable 1 is constituted by a flat cable 10 and a shielding member 20 wound around the outer periphery of the flat cable 10. Although the shielding member 20 is shown in a partially developed state for convenience of explanation in FIG. 1, it is assumed that the shielding member is not actually developed but is wound on the flat cable 10.

The flat cable 10 is constituted by a plurality (nine in FIG. 9) of conductors 11 arranged in parallel and an insulating jacket section 12 for collectively covering the plurality of conductors 11. The first device C1 and the second device C2 are devices provided on both the end sides of the flat shielded cable 1, and a signal is transmitted from the first device C1 to the second device C2 through the flat shielded cable 1 (transmitted in a unidirectional direction). Connectors, not shown, are attached to both the ends of the flat shielded cable 1, and the flat shielded cable is connected to the first device C1 and the second device C2 via the connectors. Since the flat cable 10 is used, it is preferable that the connectors to be attached thereto should be pressure contact connectors.

Figure 2:
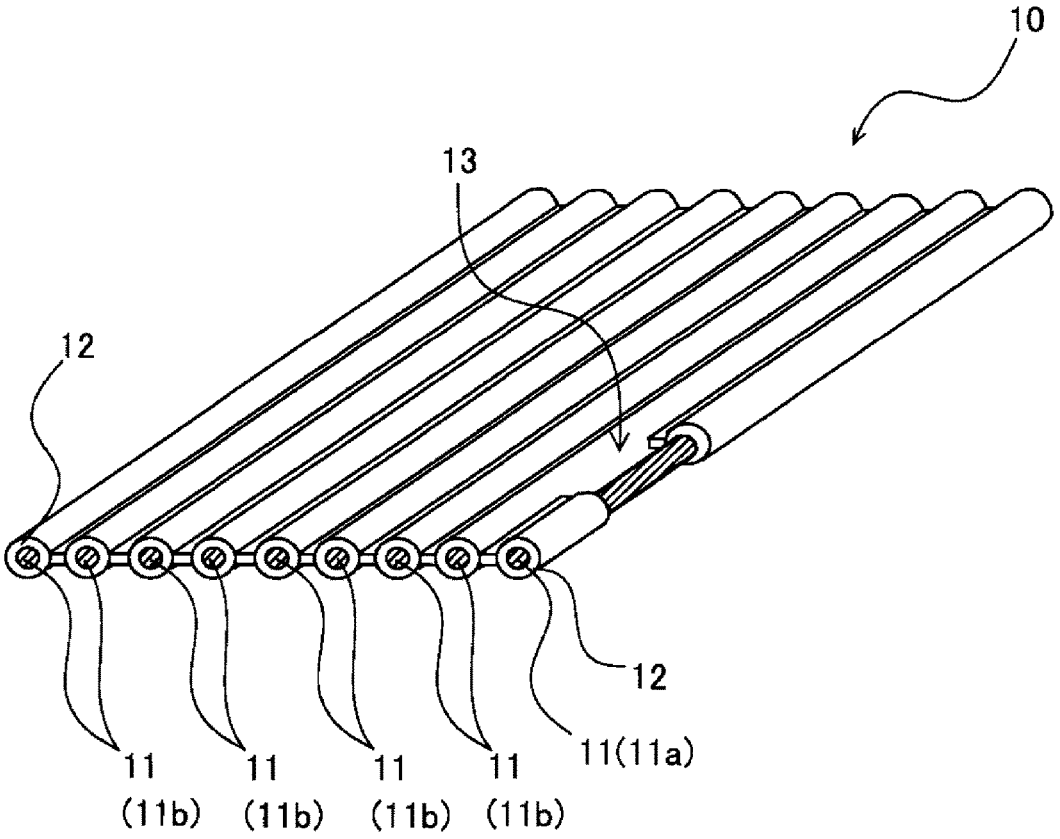
FIG. 2 is a perspective view showing the details of the flat cable shown in FIG. 1.

FIG. 2 is a perspective view showing the details of the flat cable 10 shown in FIG. 1. As shown in FIGS. 1 and 2, an exposed conductor section 13 obtained by exposing part of a single conductor 11*a* is formed in the jacket section 12 of the flat cable 10. The conductor 11*a* is provided with the exposed conductor section 13, and the end section of the conductor on the side of the second device C2 is connected to the ground.

Furthermore, the shielding member 20 shown in FIG. 1 is a sheet material constituted by at least two layers having a first layer made of metal and a second layer that is located inside the first layer in a state in which the shielding member is wound around the flat cable 10. The first layer is made of metal foil such as copper foil. The second layer is made of thermosetting resin, adhesive or solvent containing metal filler (such as silver filler). Furthermore, the second layer may be made of conductive paste.

The shielding member 20 is wound around the flat cable 10 with the second layer located on the inside, and the shielding member 20 is heated in this state, whereby the oil content in the thermosetting resin, adhesive or solvent is volatilized therefrom, and the second layer is metalized. In this metalized state, the second layer is connected to the conductor 11*a* via the exposed conductor section 13, whereby the conductor 11*a* is electrically connected to the first layer of the shielding member 20.

In the flat shielded cable 1 configured as described above, external noise is received by the first layer of the shielding member 20, and the noise flows as an induction current from the second layer to the conductor 11*a* via the exposed conductor section 13 and is grounded at the end section of the conductor 11*a* on the side of the second device C2. The signal from the first device C1 is transmitted to the second device C2 via conductors 11*b* (conductors 11*b* excluding the conductor 11*a* from the plurality of conductors 11) not provided with the exposed conductor section 13.

The inventors of the present invention have found that, in the case in which the induction current generated by the noise is transferred in the same direction as the direction of the signal and grounded as in the configuration shown in FIGS. 1 and 2, the induction current hardly affects the signal, and the shielding performance of the flat shielded cable is enhanced. In this embodiment, the signal is transmitted from the first device C1 to the second device C2. Furthermore, the end section of the conductor 11*a* serving as a drain wire on the side of the second device C2 is grounded. Hence, in the drain wire, the induction current flows from the exposed conductor section 13 to the end section of the drain wire on the side of the second device C2, whereby the induction current flows in the same direction as the direction of the signal from the first device C1 to the second device C2.

Moreover, the inventors of the present invention have also found that, in the case in which the exposed conductor section 13 is formed on the side of the conductor 11*a* serving as the drain wire closer to the second device C2 (that is, on the side of the ground) than to the first device C1, the shielding performance of the flat shielded cable is enhanced. Still further, the inventors have also found that, in particular, it is preferable that the position of the exposed conductor section 13 should be away from the end section of the shielding member 20 by a distance of 150 mm or less. Hence, in this embodiment, as shown in FIG. 1, the distance L from the end section of the shielding member 20 (the end section thereof on the side of the second device C2) to the end section of the exposed conductor section 13 on the side of the first device C1 is set to 150 mm or less.

Next, for example, the shielding effect of the wire harness according to this embodiment will be described.

Figure 3A:
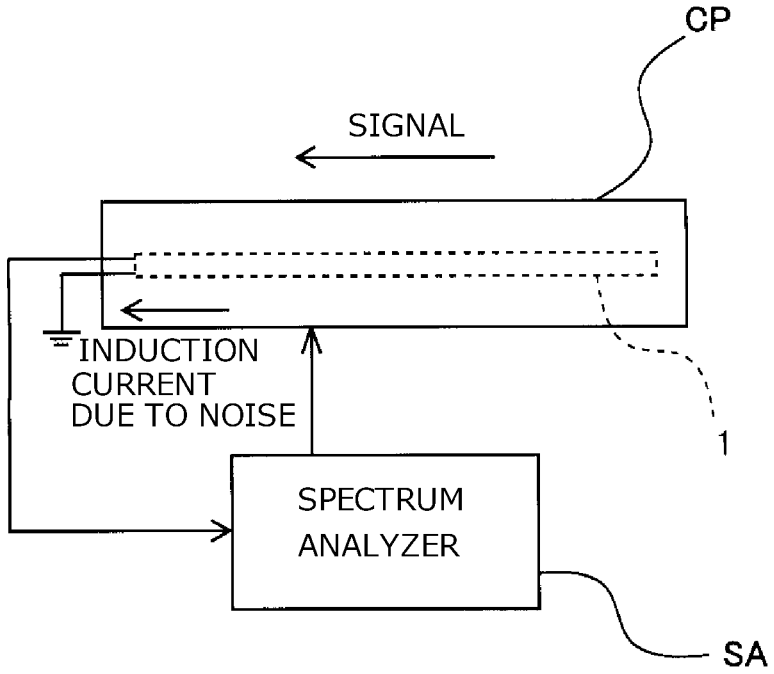
FIGS. 3A and 3B are schematic views showing, for example, a measuring apparatus for measuring the influence of noise on a signal.
Figure 3B:
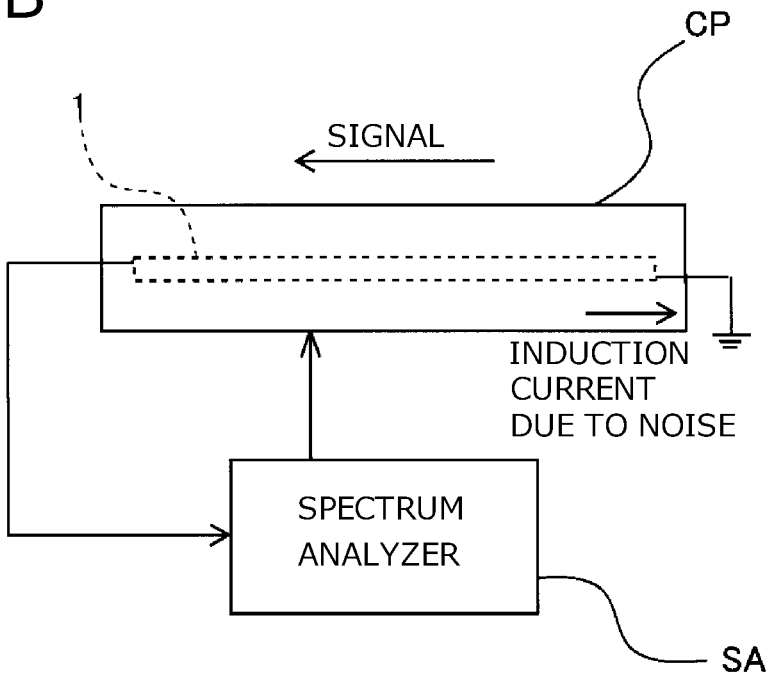

FIGS. 3A and 3B are schematic views showing, for example, a measuring apparatus for measuring the influence of noise on a signal; FIG. 3A shows a first example, and FIG. 3B shows a second example. As shown in FIGS. 3A and 3B, roughly speaking, the measuring apparatus is constituted by a spectrum analyzer SA and a copper pipe CP. Inside the copper pipe CP, the flat shielded cable 1 is accommodated. The spectrum analyzer SA is connected to the copper pipe CP, and a signal corresponding to noise is applied to the copper pipe CP. The noise applied to the copper pipe CP is propagated through the space and reaches the shielding member 20 of the flat shielded cable 1. The induction current based on the noise transmitted to the shielding member 20 reaches the conductor 11*a* provided with the exposed conductor section 13 and is grounded.

Furthermore, a signal is supplied to the conductor 11*b* of the flat shielded cable 1, and, on the basis of the difference between the signal input to the flat shielded cable 1 and the signal output from the flat shielded cable 1, the spectrum analyzer SA calculates how much the noise affects the signal, thereby measuring the shielding effect (dB) of the cable.

Moreover, in the example shown in FIG. 3A, one end side of the flat shielded cable 1 is connected to the ground, thereby making the induction current and the signal to flow in the same direction. On the other hand, in the example shown in FIG. 3B, the other end side of the flat shielded cable 1 is connected to the ground, thereby making the induction current and the signal to flow in the opposite directions. In both the examples shown in FIGS. 3A and 3B, the distance from the end section of the cable on the side of the ground to the exposed conductor section 13 in the example shown in FIG. 3A is the same as that in the example shown in FIG. 3B.

Figure 4:
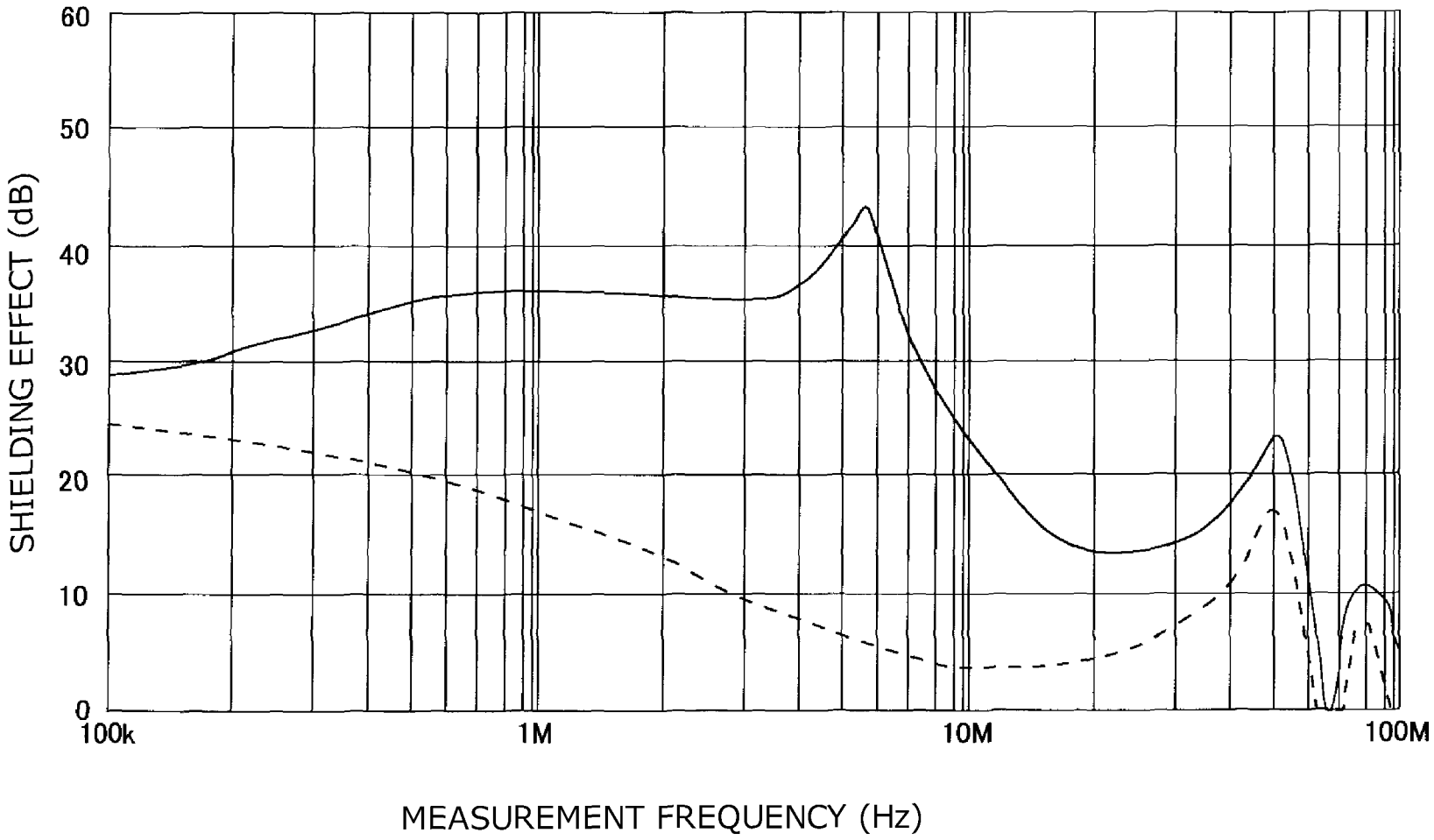
FIG. 4 is a graph showing the measurement results obtained by measuring the shielding effect for various frequency signals using the apparatus shown in FIGS. 3A and 3B.

FIG. 4 is a graph showing the measurement results obtained by measuring the shielding effect for various frequency signals using the apparatus shown in FIGS. 3A and 3B. In FIG. 4, the solid line indicates the case in which the induction current and the signal flow in the same direction, and the broken line indicates the case in which the induction current and the signal flow in the opposite directions.

As shown in FIG. 4, the results indicate that, in the signal frequency range from 100 kHz to 100 MHz, the shielding effect is higher in the case in which the induction current and the signal flow in the same direction than in the case in which the induction current and the signal flow in the opposite directions. Hence, it is found that the shielding effect is enhanced by grounding the flat shielded cable so that the induction current generated by the noise is made to flow in the same direction as the direction of the signal. This is because of the following reasons.

Figure 5A:
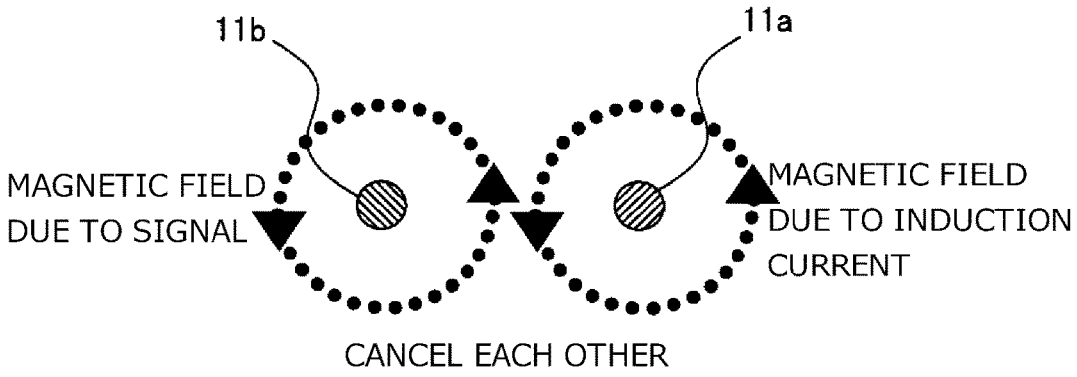
FIGS. 5A and 5B are schematic views showing how magnetic fields are generated by an induction current and a signal.
Figure 5B:
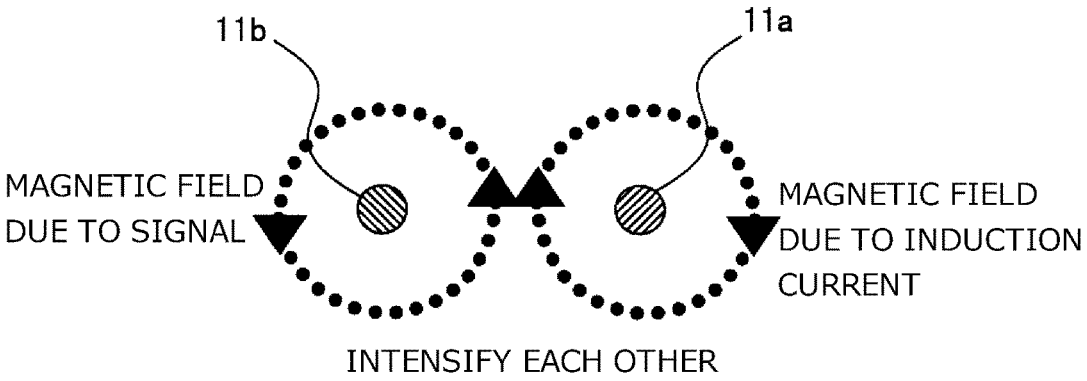

FIGS. 5A and 5B are schematic views showing how magnetic fields are generated by the induction current and the signal; FIG. 5A shows the case in which the induction current and the signal flow in the same direction, and FIG. 5B shows the case in which the induction current and the signal flow in the opposite directions.

As shown in FIG. 5A, in the case in which the induction current generated by the noise and the signal flow in the same direction, the magnetic field due to the induction current and the magnetic field due to the signal are generated in the same direction. Hence, the magnetic fields cancel each other between the conductor 11*a* serving as the drain wire and the conductor 11*b* serving as the signal line. As a result, it is assumed that the noise hardly affects the signal.

On the other hand, as shown in FIG. 5B, in the case in which the induction current and the signal flow in the opposite directions, the magnetic field due to the induction current and the magnetic field due to the signal are generated in the opposite directions. Hence, the magnetic fields intensify each other between the conductor 11*a* serving as the drain wire and the conductor 11*b* serving as the signal line. As a result, it is assumed that the noise easily affects the signal.

As described above, the shielding effect can be enhanced by carrying out grounding so that the induction current and the signal flow in the same direction.

Figure 6:
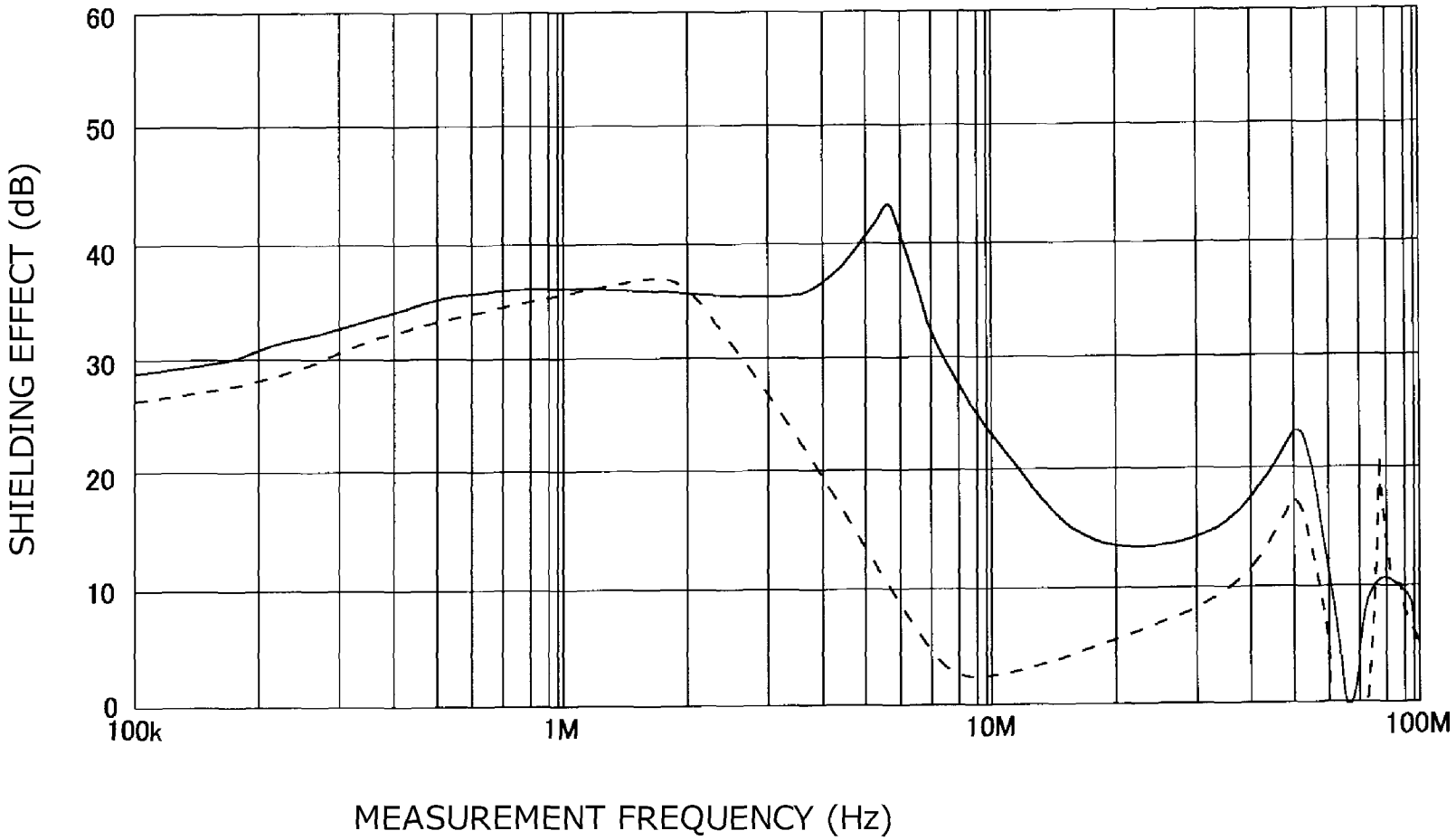
FIG. 6 is a second graph showing the measurement results obtained by measuring the shielding effect for various frequency signals using the apparatus shown in FIGS. 3A and 3B.

FIG. 6 is a second graph showing the measurement results obtained by measuring the shielding effect for various frequency signals using the apparatus shown in FIGS. 3A and 3B. In FIG. 6, the induction current and the signal are made to flow in the same direction. In FIG. 6, the solid line indicates the case in which the exposed conductor section 13 is formed on the side of the ground, and the broken line indicates the case in which the exposed conductor section 13 is formed on the opposite side of the ground.

As shown in FIG. 6, the results indicate that, in the signal frequency range from 100 kHz to 100 MHz, the shielding effect is higher in the case in which the exposed conductor section 13 is formed close to the side of the ground than in the case in which the exposed conductor section 13 is formed away from the side of the ground. Hence, it has been found that the shielding effect is enhanced in the case in which the exposed conductor section 13 is formed on the side of the ground.

This is because the induction current flows only a relatively short distance through the conductor 11*a* in the case in which the exposed conductor section 13 is formed close to the side of the ground. In other words, since the distance through which the induction current flows becomes short, the magnetic field generating distance due to the induction current also becomes short, whereby the induction current hardly affects the signal.

Figure 7:
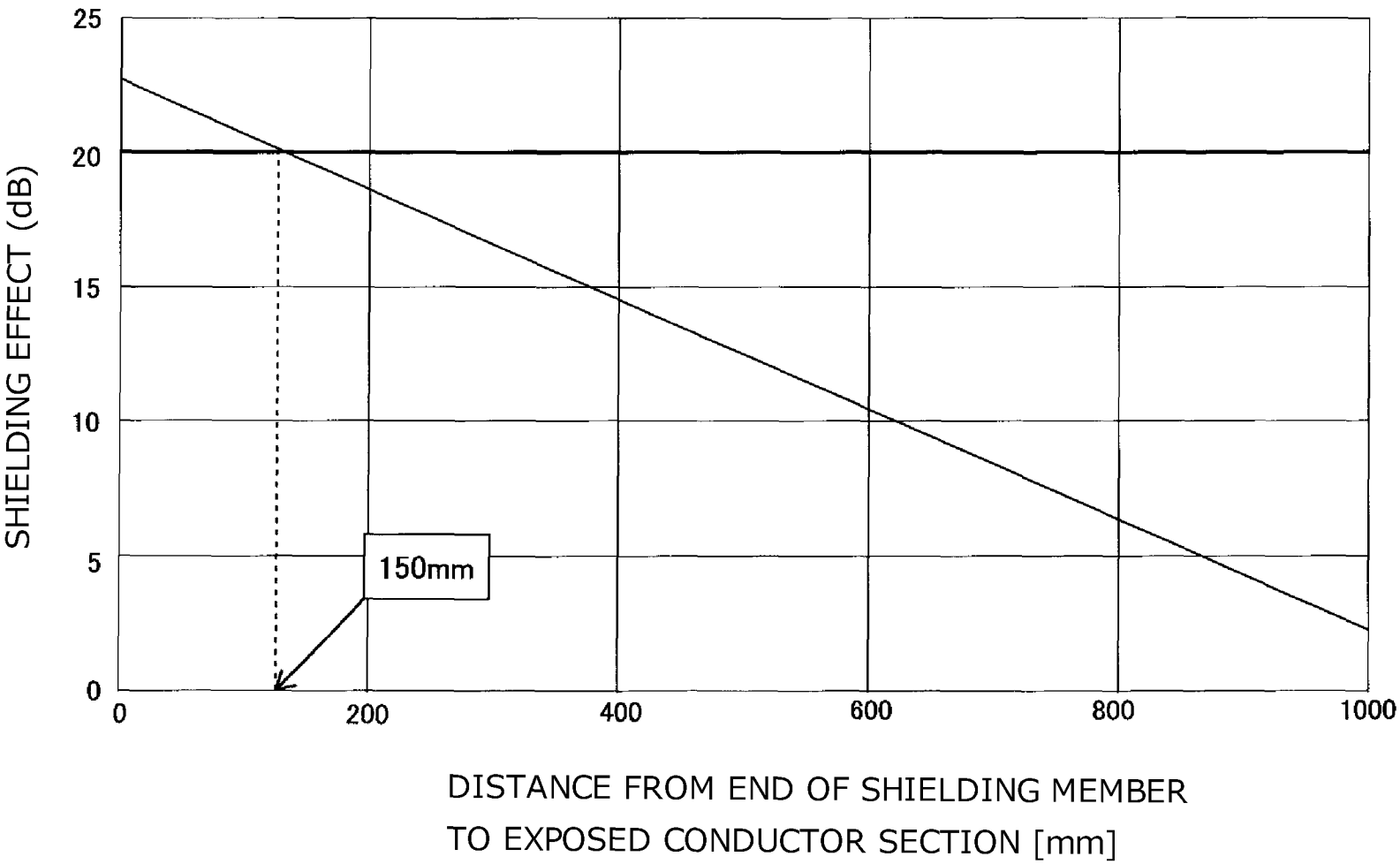
FIG. 7 is a graph showing the correlation between the shielding effect and the distance from the end section of a shielding member to an exposed conductor section.

FIG. 7 is a graph showing the correlation between the shielding effect and the distance from the end section of the shielding member 20 to the exposed conductor section 13. FIG. 7 shows the shielding effect at a signal frequency of 10 MHz.

As shown in FIG. 7, as the distance L (see FIG. 1) from the end section of the shielding member 20 to the exposed conductor section 13 becomes longer, the shielding effect tends to become lower. Hence, the above-mentioned distance is required to be 150 mm or less in order to achieve a shielding effect of 20 dB, for example. It is needless to say that the shielding effect of 20 dB reduces the noise by 99% or more.

Hence, with the wire harness WH according to this embodiment, since the conductor 11*a* provided with the exposed conductor section 13 is connected to the ground at the portion of the conductor on the side of the second device C2 rather than the portion provided with the exposed conductor section 13, the induction current generated by the noise and flowing through the conductor 11*a* flows in the direction toward the second device C2. Furthermore, since the signal flows from the first device C1 to the second device C2 through the conductor 11*b* that is not provided with the exposed conductor section 13, the induction current and the signal flow in the same direction. The inventors of the present invention have found that, in the case in which the induction current is transmitted in the same direction as the direction of the signal and grounded, the noise hardly affects the signal. Consequently, the shielding performance can be improved by making the induction current and the signal to flow in the same direction.

Moreover, since the exposed conductor section 13 is formed on the side of the conductor 11*a* closer to the second device C2 than to the first device C1, the induction current generated by the noise flows only a relatively short distance through the conductor 11*a*. Hence, the influence of the noise on the signal can be further reduced, and the shielding performance can be further improved.

Still further, since the exposed conductor section 13 is formed at the portion of the shielding member 20 away from the end section of the shielding member on the side of the second device C2 by a distance of 150 mm or less, the exposed conductor section 13 is formed at the portion closer to the side of the second device C2 in the range of the conductor 11*a* protected by the shielding member 20, whereby the induction current is made to flow only a further shorter distance through the conductor 11*a* and the shielding performance can be further improved.

Although the present invention has been described above on the basis of the embodiment, the present invention is not limited to the above-mentioned embodiment, but can be modified or combined with other technologies (including well-known and known technologies) within the scope not departing from the gist of the present invention.

For example, although the plurality of conductors 11 is arranged in parallel on a single plane in the flat cable 10 according to the above-mentioned embodiment, the plurality of conductors 11 may be arranged in parallel on two or more planes. Furthermore, the flat cable 10 is not limited to the flat cable having nine conductors 11 (nine-core cable), but may merely have two or more conductors 11.

In addition, the exposed conductor section 13 may be formed by exposing two or more conductors 11. Furthermore, although the exposed conductor section 13 is formed by exposing the whole circumference of the conductor 11*a* in FIG. 1, the exposed conductor section 13 is not limited to have this configuration, but the exposed conductor section 13 may be formed by exposing only part of the conductor 11*a* in the circumferential direction, such as only the upper face side thereof.

Moreover, the shielding member 20 is not limited to have the two-layer structure constituted by the first layer and the second layer, but may have three or more layers. What's more, the ground connection is not limited to be made at the end section of the conductor 11*a*, but the ground connection may be made at a portion on the slightly central side of the conductor 11*a*, provided that the portion is in the vicinity of the end section.

Still further, although the wire harness WH according to this embodiment is used to carry out signal transmission from the first device C1 to the second device C2, signal transmission is not limited to this type. In the case in which signal transmission is carried out from the first device C2 to the second device C1 or carried out bidirectionally, the wire harness may be configured as described below. More specifically, in the case in which one end section of the conductor 11*a* serving as the drain wire is connected to the ground, it may be possible to adopt only a configuration in which the exposed conductor section 13 is formed on the side of the conductor 11*a* closer to the one end section than to the other end section. This is because, with this configuration, the shielding performance can also be improved.

What is claimed is:

1. A wire harness comprising:

a flat shielded cable comprising:

a plurality of conductors arranged in parallel to each other;

an insulating jacket section that covers the plurality of conductors and that has a plurality of annular first portions, each of the plurality of annular first portions covering a conductor of the plurality of conductors, and at least one second portion connecting adjacent ones of said plurality of annular first portions, the insulating jacket section having an exposed conductor section which exposes a part of at least one conductor of the plurality of conductors by removing a part of an annular first portion of the plurality of annular first portions; and a shielding member that covers an outer periphery of the insulating jacket section, the part of the at least one conductor of the plurality of conductors being electrically connected to the shielding member via the exposed conductor section;

a first device configured to be connected to one end of the flat shielded cable by at least one other conductor of the plurality of conductors other than the at least one conductor provided with the exposed conductor section; and a second device configured to be connected to the other end of the flat shielded cable by the at least one other conductor of the plurality of conductors other than the at least one conductor provided with the exposed conductor section, wherein a signal is transmitted from the first device to the second device through the at least one other conductor of the plurality of conductors other than the at least one conductor provided with the exposed conductor section;

wherein the at least one conductor of the plurality of conductors provided with the exposed conductor section is connected to a ground at a position between the exposed conductor section and the second device; and wherein the exposed conductor section exposes a whole circumference of the part of the at least one conductor of the plurality of conductors.

2. The wire harness according to claim 1, wherein the exposed conductor section is provided so that a distance between the exposed conductor section and the second device is smaller than a distance between the exposed conductor section and the first device.

3. The wire harness according to claim 2, wherein the exposed conductor section is provided at a position away from an end section of the shielding member connected to the second device by a distance of 150 mm or less.

4. A wire harness comprising:

a flat shielded cable comprising:

a plurality of conductors arranged in parallel to each other;

an insulating jacket section that covers the plurality of conductors and that has a plurality of annular first portions, each of the plurality of annual first portions covering a conductor of the plurality of conductors, and at least one second portion connecting adjacent ones of said plurality of annular first portions, the insulating jacket section having an exposed conductor section which exposes a part of at least one conductor of the plurality of conductors by removing a part of an annular first portion of the plurality of annular first portions; and a shielding member that covers an outer periphery of the insulating jacket section, the part of the at least one conductor of the plurality of conductors being electrically connected to the shielding member via the exposed conductor section, wherein the at least one conductor of the plurality of conductors provided with the exposed conductor section is connected to a ground at a first end;

wherein, in the flat shielded cable, the exposed conductor section is provided at a position closer to the first end than to a second end of the at least one conductor of the plurality of conductors, opposite the first end;

wherein at least one other conductor of the plurality of conductors other than the at least one conductor provided with the exposed conductor section is configured to connect to a first device and a second device; and wherein the exposed conductor section exposes a whole circumference of the part of the at least one conductor of the plurality of conductors.

5. The wire harness according to claim 4, wherein the at least one conductor of the plurality of conductors is connected to the ground at a position between the exposed conductor section and the first end of the at least one conductor of the plurality of conductors.

* * * * *